United States Patent [19]

Lonnemo et al.

[11] Patent Number: 4,753,157

[45] Date of Patent: Jun. 28, 1988

[54] POWER TRANSMISSION

[75] Inventors: Kurt R. Lonnemo, Bloomfield Hills; Nalin J. Shah, Sterling Heights, both of Mich.

[73] Assignee: Vickers, Incorporated, Troy, Mich.

[21] Appl. No.: 2,857

[22] Filed: Jan. 13, 1987

Related U.S. Application Data

[63] Continuation-in-part of Ser. No. 754,644, Jul. 12, 1985, abandoned.

[51] Int. Cl.[4] ..... F15B 11/08

[52] U.S. Cl. ..... 91/455; 91/454; 91/461; 91/462; 137/596.15

[58] Field of Search ..... 137/625.66, 596.15; 91/421, 420, 433, 455, 461, 454, 462; 60/445, 452

[56] References Cited

U.S. PATENT DOCUMENTS

| | | | |
|---|---|---|---|
| 2,961,001 | 11/1960 | Pippenger | 137/625.63 |
| 3,635,021 | 1/1972 | McMillen et al. | 417/222 X |
| 3,949,645 | 4/1976 | Masclet | 137/625.64 X |
| 4,407,122 | 10/1983 | Nanda | 60/452 |

*Primary Examiner*—Edward K. Look

*Attorney, Agent, or Firm*—Barnes, Kisselle, Raisch, Choate, Whittemore & Hulbert

[57] ABSTRACT

A hydraulic control system comprising a hydraulic actuator having opposed openings adapted to alternately function as inlets and outlets for moving the element of the actuator in opposite directions and a variable displacement pump with loading sensing control for supplying fluid to said actuator. A pilot operated spool type meter-in valve is provided to which the fluid from the pump is supplied and a pilot controller alternately supplies fluid at pilot pressure to the meter-in valve for controlling the direction and displacement of movement of the meter-in valve and the direction and velocity of the actuator. A pair of lines extends from the meter-in valve to the respective openings of the actuator and a pilot operated meter-out valve is associated with each line of the actuator for controlling the flow out of the actuator when that line to the actuator does not have pressure fluid from the pump applied thereto. Pressure of fluid in the line to the actuator, which does not have pressure fluid from the pump, is applied to the meter-in valve to apply a centering force which aids the pressure compensating flow forces to keep the flow constant.

12 Claims, 5 Drawing Sheets

POWER TRANSMISSION

This application is a continuation-in-part of application Ser. No. 754,644 filed July 12, 1985 now abandoned.

This invention relates to power transmission and particularly to a hydraulic circuit for actuators such as are found in earth moving equipment including excavators and cranes.

BACKGROUND AND SUMMARY OF THE INVENTION

In U.S. Pat. No. 4,201,052, there is disclosed a hydraulic circuit control system comprising an actuator having opposed openings adapted to alternately function as inlets and outlets for moving the element of the actuator in opposite directions and a variable displacement pump with loading sensing control for supplying fluid to said actuator. A pilot operated spool type meter-in valve is provided to which the fluid from the pump is supplied and a pilot controller alternately supplies fluid at pilot pressure to the meter-in valve for controlling the direction and displacement of movement of the meter-in valve and the direction and velocity of the actuator. A pair of lines extend from the meter-in valve to the respective openings of the actuator and a pilot operated meter-out valve is associated with each line to the actuator for controlling the flow out of the actuator when the line to the actuator does not have pressure fluid from the pump applied thereto.

In such a hydraulic circuit, pressure compensation, and resultant constant flow, is achieved by utilization of flow forces in conjunction with the spring rate which tend to center the spool of the meter-in valve. The amount of pressure compensation may allow variation in flow when the pressure drop varies from the normal load sensing point.

In most cases, this performance is acceptable and the operator would not notice the change in flow in operating the actuator. However, in some cases, particularly motor applications, greater accuracy may be needed.

Accordingly, among the objections of the present invention is to provide greater accuracy of pressure compensation at low cost.

In accordance with the invention, pressure of fluid in the line to actuator, which does not have pressure fluid from the pump, is applied to the meter-in valve to apply a centering force which aids the pressure compensating flow forces to keep the flow constant. More specifically, feedback pins are associated with the spool of the meter-in valve and pressure from the line to the actuator which does not have pump pressure applied thereto, is applied to one of the pins to apply a centering force on the spool of the meter-in valve which aids the pressure compensating flow forces to keep the flow constant.

DESCRIPTION

This invention relates to hydraulic control systems such as shown in U.S. Pat. No. 4,201,052, which is incorporated herein by reference.

Figure 1:
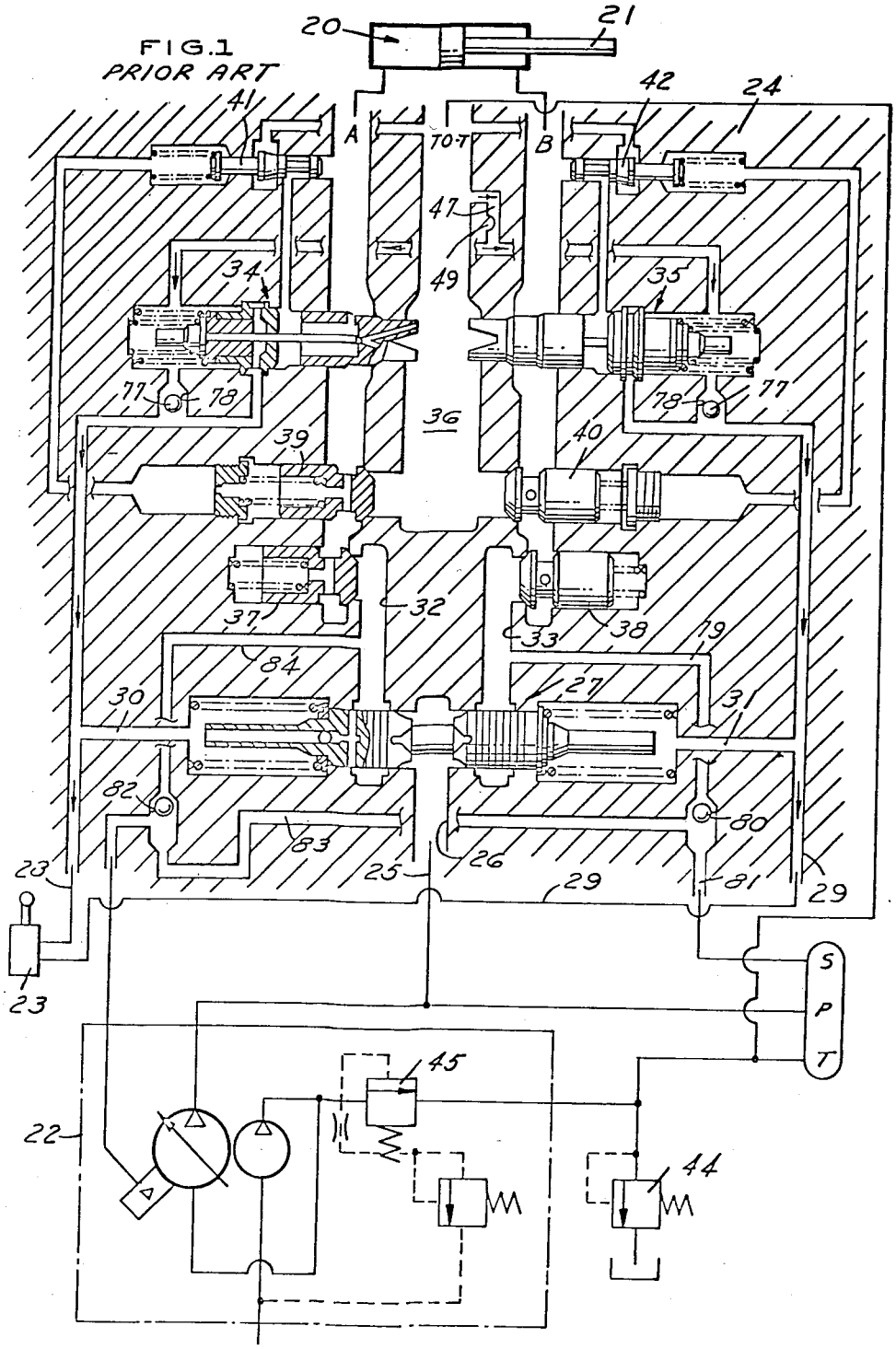
FIG.1 PRIOR ART
FIG. 1 is a diagrammatic view of a prior art hydraulic system.

Referring to FIG. 1, such a hydraulic system comprises an actuator 20, herein shown as a hydraulic cylinder, having a rod 21, that is moved in opposite directions by hydraulic fluid supplied from a variable displacement pump system 22 which has load sensing control in accordance with conventional construction. The hydraulic system further includes a manually operated controller 23 that directs a pilot pressure to a valve system 24 for controlling the direction of movement of the actuator, as presently described. Fluid from the pump 22 is directed to the line 25 and passages 26 to a meter-in valve 27 that functions to direct and control the flow of hydraulic fluid to one or the other end of the actuator 20. The meter-in valve 27 is pilot presure controlled by controller 23 through lines 28, 29 and passages 30, 31 to the opposed ends thereof, as presently described. Depending upon the direction of movement of the valve, hydraulic fluid passes through passages 32, 33 to one or the other end of the actuator 20.

The hydraulic system further includes a meter-out valve 34, 35 associated with each end of the actuator in passages 32, 33 for controlling the flow of fluid from the end of the actuator to which hydraulic fluid is not flowing from the pump to a tank passage 36, as presently described.

The hydraulic system further includes spring loaded poppet valves 37, 38 in the lines 32, 33 and spring loaded anti-cavitation valves 39, 40 which are adapted to open lines 32, 33 to the tank passage 36. In addition, spring loaded poppet valves 41, 42 are associated with each meter-out valve 34, 35 as presently described. A bleed line 47 having an orifice 49 extends from passage 36 to meter-out valves 34, 35 and to the pilot control lines 28, 29 through check valves 77.

The system also includes a back pressure valve 44 associated with the return or tank line. Back pressure valve 44 functions to minimize cavitation when an overrunning or a lowering load tends to drive the actuator down. A charge pump relief valve 45 is provided to take excess flow above the inlet requirements of the pump 22 and apply it to the back pressure valve 44 to augment the fluid available to the actuator.

Figure 2:
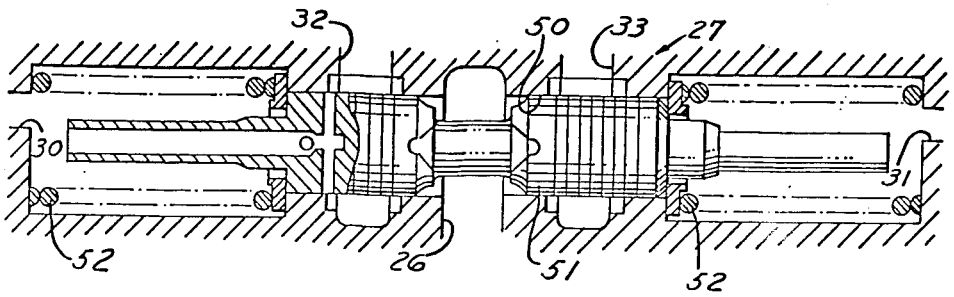
FIG. 2 PRIOR ART
FIG. 2 is a diagrammatic view of a meter-in valve utilized in the system.

Referring to FIG. 2, the meter-in valve 27 comprises a bore 50 in which a spool 51 is positioned and in the absence of pilot pressure maintained in a neutral position by springs 52. The spool 51 normally blocks the flow from the pressure passage 26 to the passages 32, 33. When pilot pressure is applied to either passage 30 or 31, the meter-in spool 51 is moved in the direction of the pressure until a force balance exists among the pilot pressure, the spring load and the flow forces. The direction of movement determines which of the passages 32, 33 is provided with fluid under pressure from passage 26.

Figure 3:
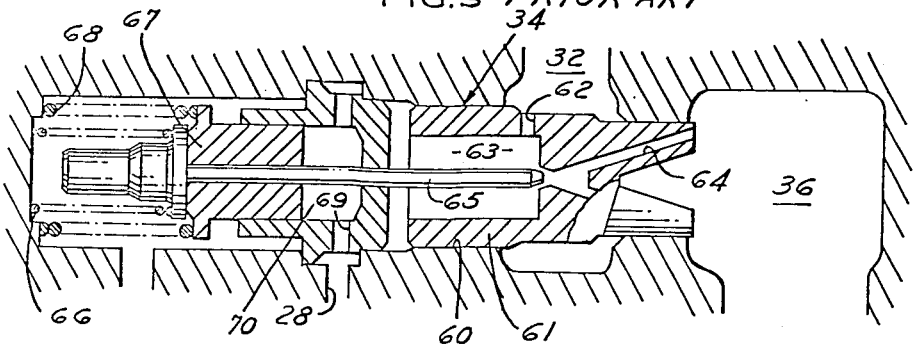
FIG. 3 PRIOR ART
FIG. 3 is a diagrammatic view of a meter-out valve.

Referring to FIG. 3, each meter-out valve 34, 35 is of identical construction and, for purposes of clarity, only valve 34 is described. The meter-out valve 34 includes a bore 60 in which a poppet 61 is positioned. The poppet 61 includes a passage 62 extending to a chamber 63 within the poppet and one or more passages 64 to the tank passage 36. A stem 65 normally closes the connection between the chamber 63 and passages 64 under the action of a spring 66. The pressure in chamber 63 equalizes with the pressure in line 32 and the resulting force unbalance keeps poppet 61 seated. The valve further includes a piston 67 surrounding the stem 65 yieldingly urged by a spring 68 to the right as viewed in FIG. 3. The pilot line 28 from the controller 23 extends through a passage 69 to a chamber 70 that acts against the piston 67. When pilot pressure is applied to passage 28, the piston 67 is moved to the left as viewed in FIG. 3 moving the stem 65 to the left permitting chamber 63 to be vented to tank passage 36 via passage 64. The resulting force unbalance causes poppet 61 to move to the left connecting line 32 to passage 36.

It can thus be seen that the same pilot pressure which functions to determine the direction of opening of the meter-in valve also functions to determine and control the opening of the appropriate meter-out valve so that the fluid in the actuator can return to the tank line.

Figure 4:
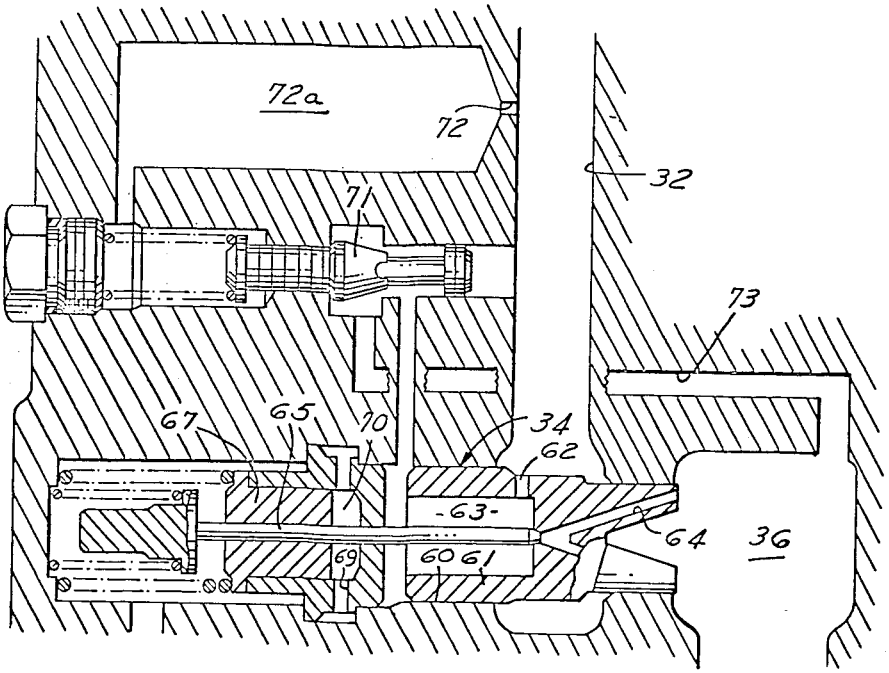
FIG. 4 PRIOR ART
FIG. 4 is a diagrammatic view of a port relief valve and meter-out valve.

Referring to FIG. 4, each of the meter-out valves has associated therewith a spring loaded pilot spool 71 which functions when the load pressure in passage 32 exceeds a predetermined value to open a flow path from the load through a control orifice 62 to the tank passage 36 through an intermediate passage 73. This bleed flow reduces the pressure and closing force on the left end of the poppet valve 61 permitting the valve 61 to move to the left and allowing flow from passage 32 to the return or tank line 36. In order to prevent overshoot when the pressure rises rapidly, an orifice 72 and associated chamber **72*a* are provided so that there is a delay in the pressure build-up to the left of poppet valve 71. As a result, poppet valves 71 and 61** will open sooner and thereby control the rate of pressure rise and minimize overshoot.

In the case of an energy absorbing load, when the controller 23 is moved to operate the actuator 20 in a predetermined direction, pilot pressure applied through line 28 and passage 30 moves the spool of the meter-in valve to the right causing hydraulic fluid under pressure to flow through passage 33 opening poppet valve 38 and continuing to the inlet B of actuator 20. The same pilot pressure is applied to the meter-out valve 34 permitting the flow of fluid out of the end A of the actuator 20 to the return or tank passage 36.

When the controller 23 is moved to operate the actuator, for example, for an overrunning or lowering a load, the controller 23 is moved so that pilot pressure is applied to the line 28. The meter-out valve 34 opens before the meter-in valve 27 under the influence of pilot pressure. The load on the actuator forces hydraulic fluid through the opening A of the actuator past the meter-out valve 34 to the return or tank passage 36. At the same time, the poppet valve 40 is opened permitting return of some of the fluid to the other end of the actuator through opening B thereby avoiding cavitation. Thus, the fluid is supplied to the other end of the actuator without opening the meter-in valve 27 and without utilizing fluid from the pump.

To achieve a float position, the controller 23 is bypassed and pilot pressure is applied to both pilot pressure lines 28, 29. This is achieved, for example, by the use of solenoid operated valves, not shown, which bypass controller 23 when energized and apply the fluid from pilot pump 76 directly to lines 28, 29 causing both meter-out valves 34 to open and thereby permit both ends of the actuator to be connected to tank pressure. In this situation, the meter-out valves function in a manner that the stem of each is fully shifted permitting fluid to flow back and forth between opposed ends of the cylinder, as described in U.S. Pat. No. 4,201,052, which is incorporated herein by reference.

Where the pressure in the return from end A of the actuator is excessive, the pilot spool 71 functions to permit the poppet valve 61 to open and thereby compensate for the increased pressure as well as permit additional flow to the actuator 20 through opening of the poppet valve 40 extending to the passage which extends to the other end of the actuator.

By varying the spring forces and the areas on the meter-in valve 27 and the meter-out valves 34, 35, the timing between these valves can be controlled. Thus, for example, if the timing is adjusted so that the meter-out valve leads the meter-in valve, the meter-in valve will control flow and speed in the case where the actuator is being driven. In such an arrangement with an overhauling load, the load-generated pressure will result in the meter-out valve controlling flow and speed. In such a situation, the anti-cavitation check valves 39, 40 will permit fluid to flow to the supply side of the actuator so that no pump flow is needed to fill the actuator in an overhauling load mode or condition.

With this knowledge of independent control of the meter-out and meter-in valves, varying metering arrangements can be made to accommodate the type of loading situation encountered by the particular actuator. Where there are primarily energy absorbing or driving loads, the spring and areas of the meter-out valve can be controlled so that the meter-out valve opens quickly before the meter-in valve opens. In the case of primarily overrunning loads, the meter-out valve can be caused to open gradually but much sooner than the meter-in valve so that the meter-out valve is the primary control.

A check valve 77 is provided in a branch 78 of each pilot line 28, 29 adjacent each meter-out valve 34, 35. The valves 77 allow fluid to bleed from the high tank pressure in passage 36, which fluid is relatively warm, and to circulate through pilot lines 28, 29 back to the controller 23 and the fluid reservoir when no pilot pressure is applied to the pilot lines 28, 29. When pilot pressure is applied to a pilot line, the respective check valve 77 closes isolating the pilot pressure from the tank pressure.

Provision is made for sensing the maximum load pressure in one of a series of valve systems 24 controlling a plurality of actuators and applying that higher pressure to the load sensitive variable displacement pump 22. Each valve system 24 includes a line 79 extending to a shuttle valve 80 that receives load pressure from an adjacent actuator through line 81. Shuttle valve 80 senses which of the two pressures is greater and shifts to apply the same to a shuttle valve 82 through line 83. A line 84 extends from passage 32 to shuttle valve 82. Shuttle valve 82 senses which of the pressures is greater and shifts to apply the higher pressure to pump 22. Thus, each valve system in succession incorporates shuttle valves 80, 82 which compare the load pressure therein with the load pressure of an adjacent valve system and transmit the higher pressure to the adjacent valve system in succession and finally apply the highest load pressure to pump 22.

The provision of the load sensing system and the two load drop check valves 37, 38 provide for venting of the meter in valve in neutral so that no orifices are required in the load sensing lines which would result in a horsepower loss during operation which would permit flow from the load during build up of pressure in the sensing lines. In addition, there will be no cylinder drift if other actuators are in operation. Further, the load drop check valves 37, 38 eliminate the need for close tolerances between the spool 51 and the bore 50.

In such a hydraulic circuit, pressure compensation, and resultant contains flow, is achieved by utilization of flow forces in comparison with the spring rate which tend to center the spool of the meter-in valve. The amount of pressure compensation may allow variation in flow when the pressure drop varies from the normal load sensing point.

In most cases, this performance is acceptable and the operator would not notice the change in flow in operating the actuator. However, in some cases, particularly motor applications, greater accuracy may be needed.

In accordance with the invention, pressure of fluid in the line from the actuator, which does not have pressure fluid from the pump, is applied to the meter-in valve to apply a centering force which aids the pressure compensating flow forces to keep the flow constant.

Figure 5:
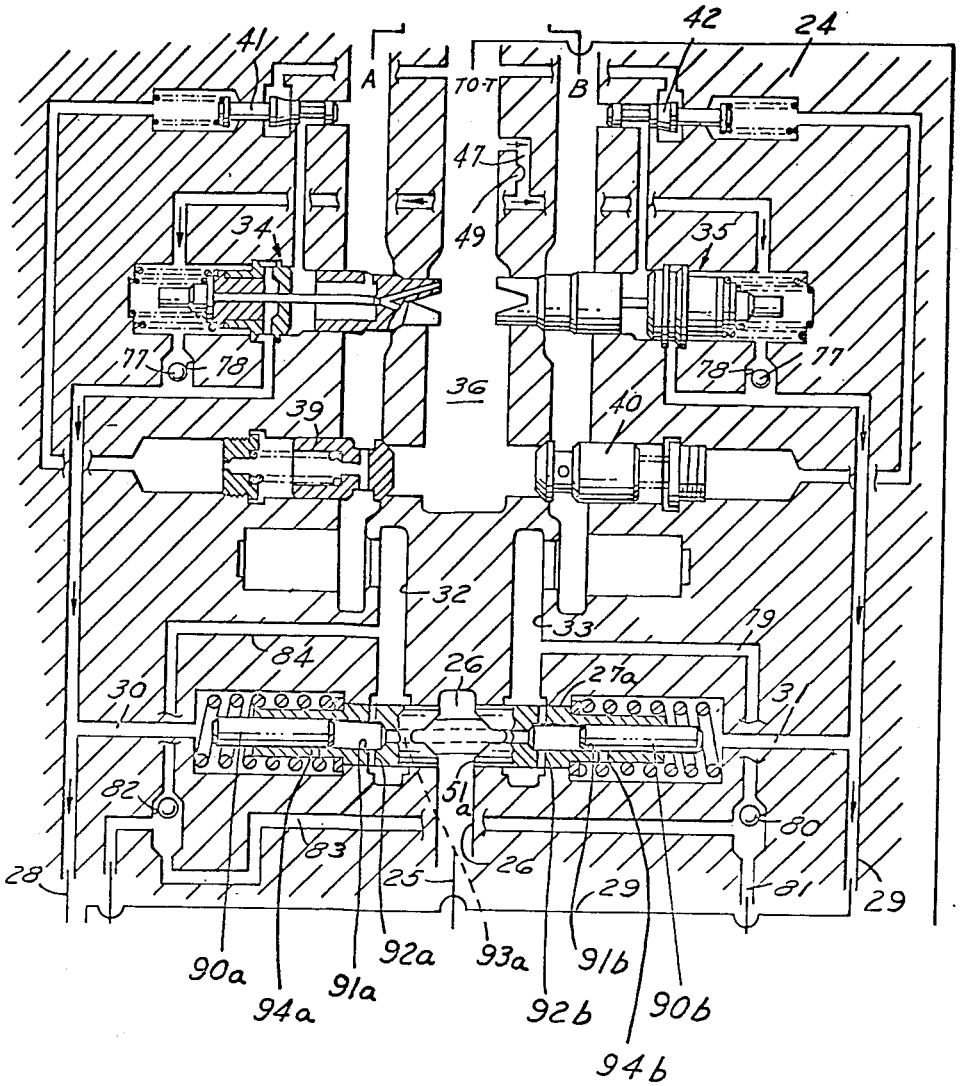
FIG. 5 is a diagrammatic view of a portion of hydraulic system embodying the invention.

Referring to FIG. 5, the load drop check valves 37, 38 are removed. The meter-in valve spool 51 is provided with pins **90*a*, 90*b* sliding in axial chambers 91*a*, 91*b* in the ends of spool 51. Chambers 91*a*, 91*b* are connected to the two cylinder ports A and B by radial openings 92*a*, 92*b* in the spool 27. An axial passage 93 interconnects chambers 91*a*, 91*b*. Load sensing radial bleed holes 94*a*, 94*b* are provided in the spool axially outwardly of openings 92*a*, 92*b***.

When the meter-in spool 27 is in neutral, any load pressure either in A or B port will act through openings **92*a* or 92*b* on pins 90*a* or 90*b*, pushing them outward and hence bleeding load pressure through loads sensing bleed holes 94*a* or 94*b* through lines 28, 29 and through controller 23** bank to tank.

Upon shifting the meter-in spool **29*a* with pilot pressure to, for example, the left and porting flow from inlet 26 to cylinder port A, passage 92*a* will be closed off and both feedback pins 90*a*, 90*b* will be exposed to cylinder port B pressure. Since the pilot pressure is always higher than the cylinder port B pressure for driving loads, the feedback pin 90*b* will be kept to the left in the bottom of the meter-in spool 27*a*. The pressure at B will, however, act upon feedback pin 90*a* and push it outwardly to the end cap. The pressure in cylinder port B is proportional to flow for a constant pilot pressure since the meter-out element metering area to tank is constant. A centering force is thus exerted on the meter-in spool 27*a*** which will aid the pressure compensating flow forces to keep the flow constant.

When the pilot pressure shifts the meter-in spool **27*a* to the left, the pressure of fluid in port B is applied through leakage between the pin 90*b* and the meter-in spool 27*a* through the opening 93*a* against the pin 90*a* to push it outwardly. The normal clearance between the pin 90*b* and its respective chamber 91*b* is sufficient to permit the pressure to be applied in this manner. Similarly, with respect the pin 90*a* and chamber 91*a* when the meter-in valve spool 27*a*** is shifted to the right. The normal clearance is adequate for the intended purpose although, as a person skilled in the art would acknowledge, the clearance could be increased if desired.

In case the flow increases, due to a larger pressure drop across the meter-in spool, the pressure drop over the meter-out element 35 will also increase (since the area remains constant). This increased pressure will act upon the feedback pin **90*a*** and end to center the meter-in spool, thus, reducing the flow so that it is substantially constant.

Figure 6:
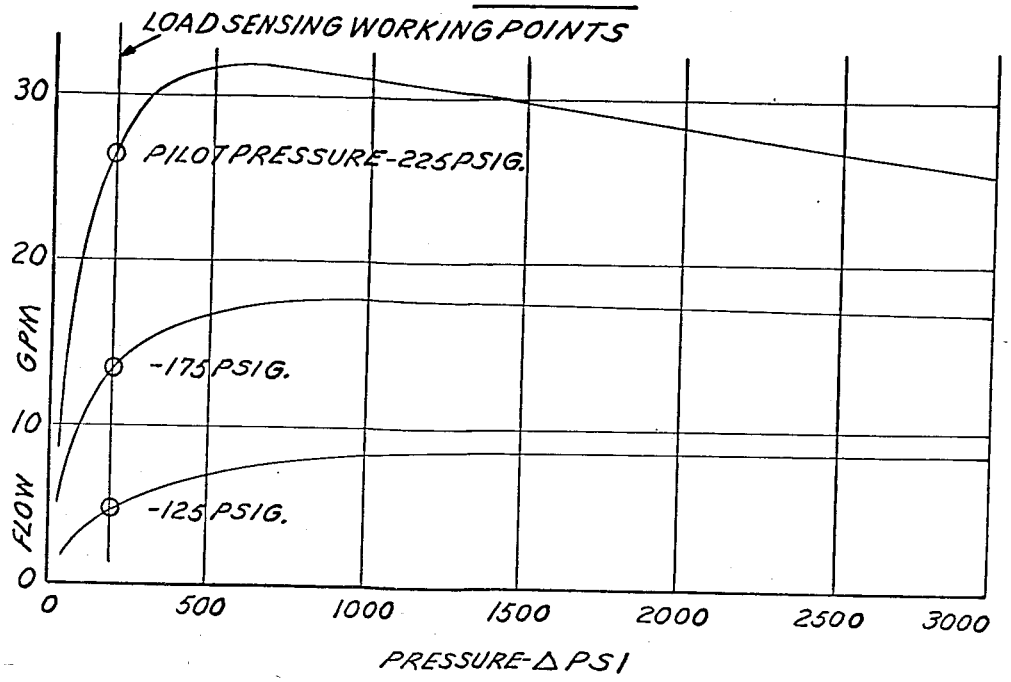
FIG.6 PRIOR ART
FIG. 6 are curves of flow versus delivery pressure of a prior art hydraulic system.
Figure 7:
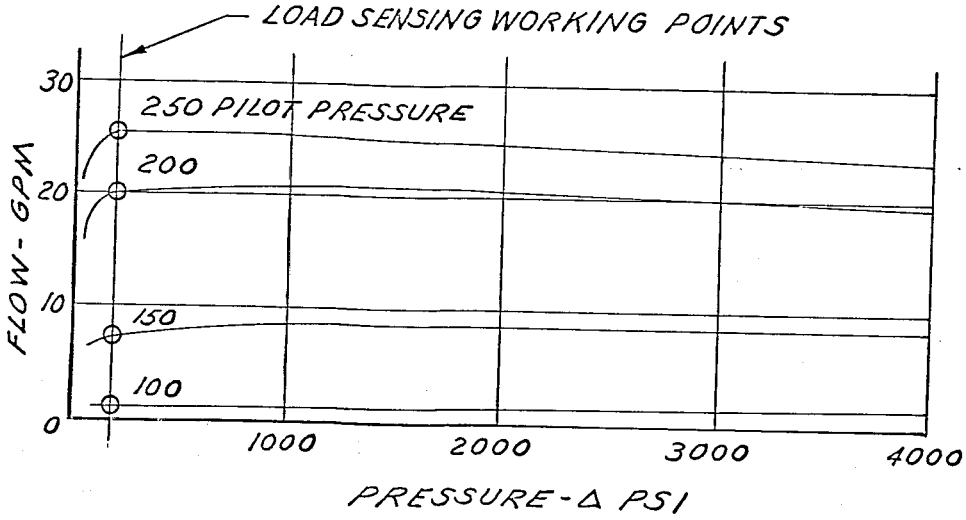
FIG. 7 are curves of flow versus delivery pressure of a hydraulic system embodying the invention.

Referring to FIG. 6, which is a series of curves of flow versus meter-in spool pressure drop of the hydraulic control circuit shown, it can be seen that the flow is not as constant as in FIG. 7, which are curves of a hydraulic control circuit embodying the invention.

Figure 8:
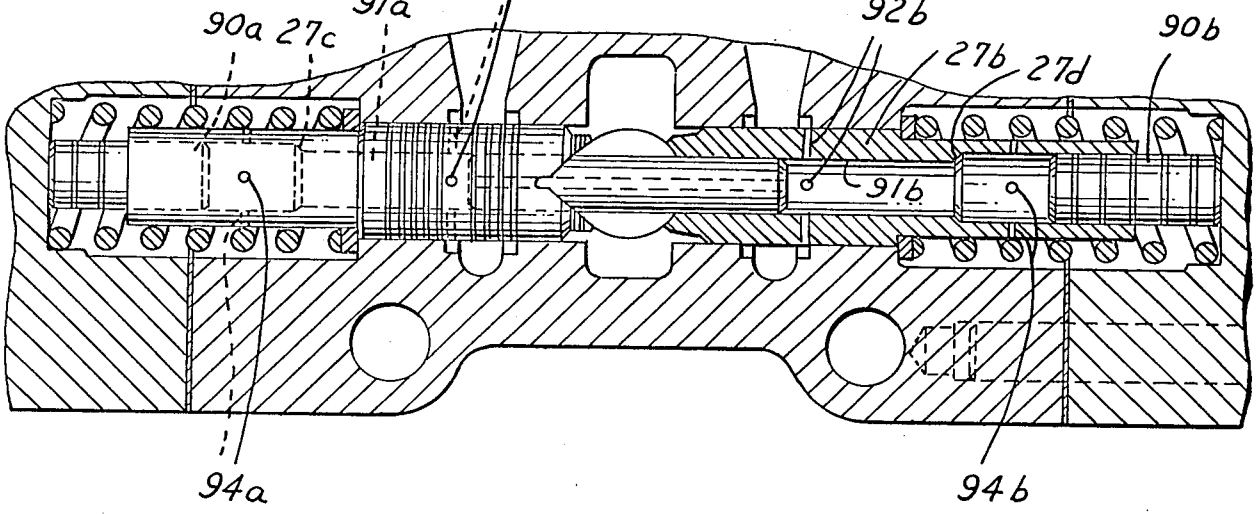
FIG. 8 is a fragmentary sectional view of a portion of a modified form of hydraulic system.

In the modified form of meter-in valve shown in FIG. 8, the body of meter-in valve **27*b* is provided with a step or shoulder 27*c* and 27*d* associated with each pin 90*a*, 90*b*, respectively. Thus, when pilot pressure is applied to one end or the other of the meter-in spool 27*a*, the associated pin 90*a* or 90*b* can not be forced inwardly such that flow to the respective chamber 91*a*, 91*b*** is assured.

We claim:

1. A hydraulic control system comprising a hydraulic actuator having opposed openings adapted to alternately function as inlets and outlets for moving the element of the actuator in opposite direction, a pump for supplying fluid to said actuator, a meter-in valve to which the fluid from the pump is supplied, said valve being pilot controlled, a pair of lines extending from said meter-in valve means to said respective openings of said actuator, a pilot controller for alternately supplying fluid at pilot pressure to said meter-in valve for controlling the direction of movement of the meter-in valve, meter-out valve means separate from and operable independently of said meter-in valve means associated with each opening of the actuator for controlling the flow out of said actuator, said meter-out valve means being pilot operated by the pilot pressure, means for directing pressure in one line from the actuator, which does not have pressure fluid from the pump, to the meter-in valve in a direction to apply a centering force which aids the pressure compensating flow forces to keep the flow constant.

2. The hydraulic control system set forth in claim 1 wherein said last-mentioned means comprises said meter-in valve means comprising a spool adapted to be actuated by pilot pressure, spring means adapted to center said spool in a neutral position, said spool having at least one axial chamber therein connected by a passage, at least one pin sliding in each said chamber, and passage means in said spool providing communication between said chamber and the line to the actuator.

3. The hydraulic control system set forth in claim 2 wherein said passage comprises a radial opening.

4. The hydraulic control system set forth in claim 3 including a load sensing bleed passage in said spool and associated with said pin such that when the meter-in spool is in neutral, any load pressure will act through first-mentioned radial opening to force the pin axially outwardly and bleed the load pressure through the load sensing bleed passage.

5. The hydraulic control system set forth in claim 2 wherein said meter-in valve means includes means for limiting the movement of each pin axially inwardly.

6. The hydraulic control system set forth in claim 5 wherein said limiting means comprises a shoulder individual to each pin adapted to engage a pin.

7. A hydraulic control system comprising a hydraulic actuator having opposed openings adapted to alternately function as inlets and outlets for moving the element of the actuator in opposite directions, a pump for supplying fluid to said actuator, a meter-in valve to which the fluid from the pump is supplied, said valve being pilot controlled, a pair of lines extending from said meter-in valve means to said respective openings of said actuator, a pilot controller for alternately supplying fluid at pilot pressure to said meter-in valve for controlling the direction of movement of the meter-in valve, meter-out valve means separate from and operable independently of said meter-in valve means associated with each opening of the actuator for controlling the flow out of said actuator, said meter-out valve means being pilot operated by the pilot pressure, means for selectively directing pressure in each line from the actuator, which does not have pressure fluid from the pump when the other line has pressure fluid from the pump, to the meter-in valve in a direction to apply a centering force which aids the pressure compensating flow forces to keep the flow constant.

8. The hydraulic control system set forth in claim 7 wherein said last-mentioned means comprises said meter-in valve means comprising a spool adapted to be actuated by pilot pressure, spring means adapted to center said spool in a neutral position, said spool having opposed axial chambers therein connected by a passage, a pin sliding in each said chamber, and passage means in said spool providing communication between each said chamber and a line to a respective actuator.

9. The hydraulic control system set forth in claim 8 wherein each said passage comprises a radial opening.

10. The hydraulic control system set forth in claim 9 including a load sensing bleed passage in said spool and associated with each said pin such that when the meter-in spool is in neutral, any load pressure will act through the first radial opening to force the pin axially outwardly and bleed the load pressure through the associated load sensing bleed passage.

11. The hydraulic control system set forth in claim 9 wherein said meter-in valve means includes means for limiting the movement of each pin axially inwardly.

12. The hydraulic control system set forth in claim 11 wherein said limiting means comprises a shoulder individual to each pin adapted to engage a pin.

* * * * *